US011549743B1

(12) United States Patent
Bonazza et al.

(10) Patent No.: US 11,549,743 B1
(45) Date of Patent: Jan. 10, 2023

(54) REFRIGERATOR APPLIANCE

(71) Applicant: WHIRLPOOL CORPORATION, Benton Harbor, MI (US)

(72) Inventors: Luca Bonazza, Cassinetta (IT); Kamil El Sayed, Wroclaw (PL); Davide Ferretti, Cassinetta (IT); Daniele Meneghini, Cassinetta (IT); Emil D. Najczuk, Wroclaw (PL); Pier Giorgio Rosso, Cassinetta (IT); Piercario Tomasina, Cassinetta (IT)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 17/470,496

(22) Filed: Sep. 9, 2021

(51) Int. Cl.
*F25D 23/06* (2006.01)

(52) U.S. Cl.
CPC ..... *F25D 23/062* (2013.01); *F25D 23/066* (2013.01); *F25D 23/069* (2013.01)

(58) Field of Classification Search
CPC .... F25D 23/062; F25D 23/063; F25D 23/066; F25D 23/069
See application file for complete search history.

(56) References Cited

U.S. PATENT DOCUMENTS 4,632,470 A * 12/1986 Jenkins ..... F25D 23/062 312/138.1
4,765,696 A * 8/1988 Cordill ..... F25D 23/067 312/407
4,862,577 A * 9/1989 Cordill ..... F25D 23/067 29/897.3
4,955,676 A * 9/1990 Weaver ..... F25D 23/069 312/236
5,064,255 A * 11/1991 Inui ..... F25D 23/02 49/504
5,255,531 A 10/1993 Williams et al.
5,992,960 A * 11/1999 Wolanin ..... F25D 21/04 312/265.5
7,407,240 B2 * 8/2008 Collins ..... F25D 23/069 312/407
8,931,863 B2 1/2015 Vulava
(Continued)

FOREIGN PATENT DOCUMENTS

CN 212205204 U 12/2020
EP 3851778 A1 * 7/2021 ..... F25D 23/006
KR 102074784 B 3/2015

*Primary Examiner* — Daniel J Rohrhoff
(74) *Attorney, Agent, or Firm* — Brooks Kushman P.C.

(57) ABSTRACT

A refrigerator includes a side panel, a U-shaped protrusion, a crossmember, a first protrusion, and a second protrusion. The U-shaped protrusion extends from the side panel. The protrusion has first and second flanges defining a space therebetween and extending horizontally into a refrigerator cavity. The first flange defines a slot and a notch. The first protrusion extends from the end of the crossmember and horizontally into the slot. The first protrusion engages the first flange within the slot to restrict horizontal movement of the crossmember relative to the side panel. The second protrusion extends from the end of the crossmember and horizontally into the notch. The second protrusion engages the first flange within the notch to restrict vertical movement of the crossmember relative to the side panel.

20 Claims, 4 Drawing Sheets

(56) References Cited

U.S. PATENT DOCUMENTS

| | | | | |
|---|---|---|---|---|
| 2012/0313497 | A1* | 12/2012 | Jang | F25D 23/069<br>312/401 |
| 2018/0073798 | A1* | 3/2018 | Bajak | F25D 23/064 |
| 2018/0156520 | A1* | 6/2018 | Lindel | F25D 23/02 |
| 2019/0212051 | A1* | 7/2019 | Mayer | F25D 23/067 |

* cited by examiner

REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator includes a housing and a crossmember. The housing defines an internal cavity. The housing has first and second side walls. The first and second side walls define an opening to the internal cavity therebetween. Each of the first and second side walls define at least one slot and at least one notch. The crossmember spans the opening, divides the internal cavity into first and second compartments, and has first and second opposing ends secured the first and second side walls, respectively. The first and second opposing ends each include at least one first protrusion extending into the at least one slot of the first and second side walls, respectively, and at least one second protrusion extending into the at least one notch of the first and second side walls, respectively. The at least one first protrusion of the first and second opposing ends engages the first and second side walls along proximal ends of the at least one slot of the first and second side walls, respectively. The at least one second protrusion of the first and second opposing ends engages the first and second side walls within the at least one notch of the first and second side walls, respectively.

A refrigerator includes a side panel, a U-shaped protrusion, a crossmember, a first protrusion, and a second protrusion. The side panel partially defines an internal cavity. The U-shaped protrusion extends from the side panel. The protrusion has first and second flanges defining a space therebetween and extending horizontally into the cavity. The first flange defines a slot and a notch. The crossmember has an end extending into the space between the first and second flanges. The first protrusion extends from the end of the crossmember and horizontally into the slot. The first protrusion engages the first flange within the slot to restrict horizontal movement of the crossmember relative to the side panel. The second protrusion extends from the end of the crossmember and horizontally into the notch. The second protrusion engages the first flange within the notch to restrict vertical movement of the crossmember relative to the side panel.

A refrigerator includes a refrigerator cabinet wrapper, a folded outer wrapper edge, at least one slot, a notch, a refrigerator reinforcement crossbar, at least one tab, and at least one protrusion. The refrigerator cabinet wrapper has a first side panel and a second side panel. The folded outer wrapper edge forms a three-sided box extending from a front region of the first side panel and the second side panel. The at least one slot is defined in at least one surface of the three-sided box. The notch is defined in the at least one surface of the three-sided box. The at least one tab and the at least one protrusion extend from a first end and a second end of the reinforcement crossbar. The at least one protrusion is configured to engage the at least one slot and the at least one tab is configured to abut the notch such that the crossbar is locked to the folded outer wrapper edge in an X-direction.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
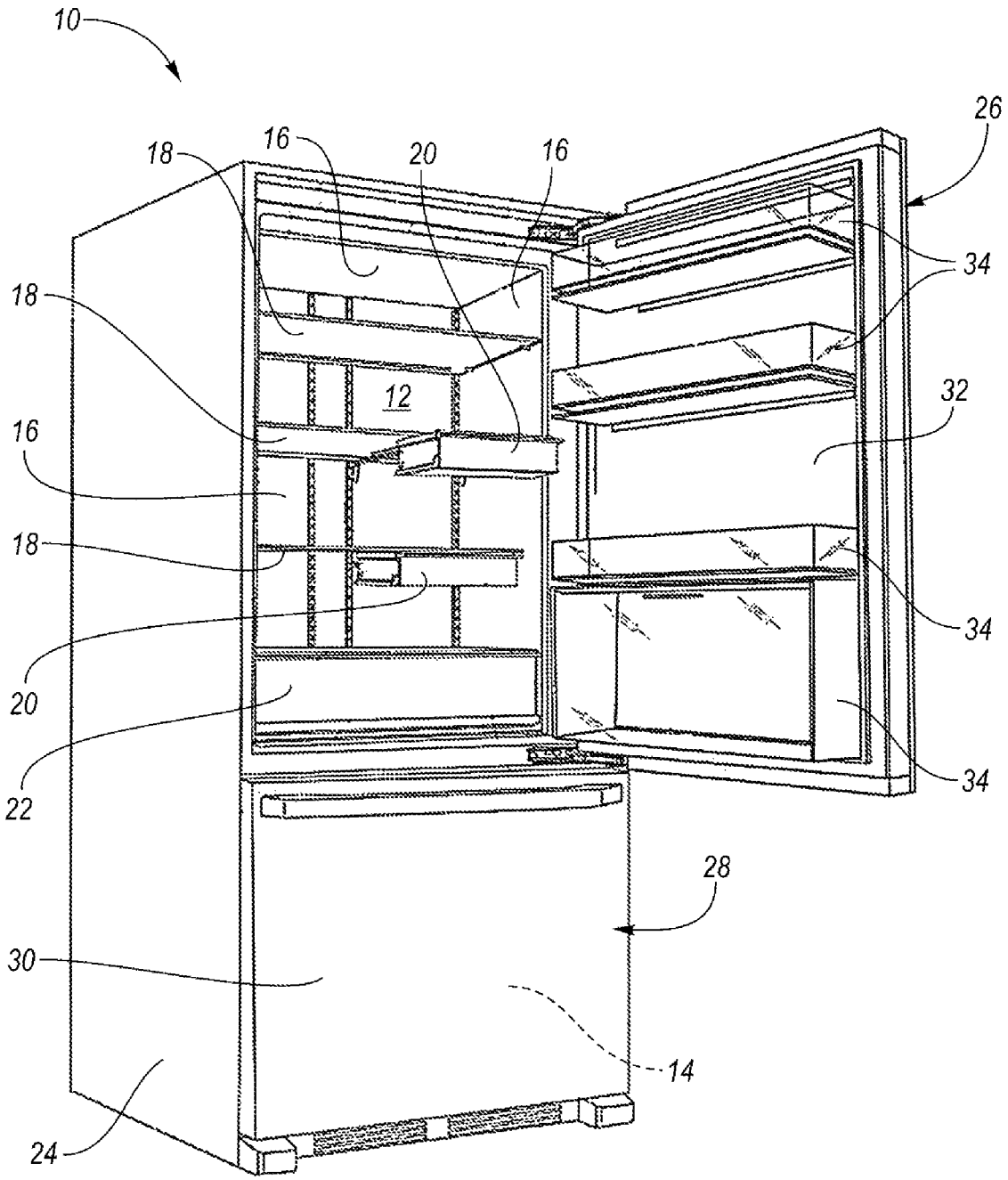
FIG. 1 is an isometric view of a bottom-mount type refrigerator appliance with the refrigeration compartment door open.

Referring to FIG. 1, generally a refrigerator 10 of the two-door bottom mount type is illustrated. However, it should be understood that this disclosure could apply to any type of refrigerator, such as a side-by-side, French-Door Bottom Mount, or a top-mount type. As shown in FIG. 1, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The refrigerator 10 includes one or more refrigeration loops (not shown) that are configured to cool the air the within the fresh food compartment 12 and the freezer compartment 14. The refrigeration loop includes at least a compressor, an evaporator that cools air being delivered to the fresh food compartment 12 and/or the freezer compartment 14, a condenser that rejects heat to ambient surroundings, and a thermal expansion valve. Fans may be utilized to direct air across the evaporator and the condenser to facilitate exchanging heat. The compressor and the fans may be connected to a controller. Sensors that measure the air temperature within the fresh food compartment 12 and the freezer compartment 14 may be in communication with the controller. The controller may be configured to operate the compressor, fans, etc. in response to the air temperature within the within the fresh food compartment 12 and the freezer compartment 14 being less than a threshold.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The refrigerator 10 includes panels or internal walls 16 that define the fresh food compartment 12 and the freezer compartment 14. The walls 16 may more specifically form an internal liner of the refrigerator 10. The walls 16 may include a rear or back wall, a top wall, a bottom wall, and two side walls. One or more shelves 18 may be secured to the walls 16 within the fresh food compartment 12. One of more drawers 20 may be slidably secured to the shelves 18 or the walls 16 within the fresh food compartment 12. A crisper drawer 22 may be slidably secured to the shelves 18 or the walls 16 within the fresh food compartment 12. The crisper drawer 22 may more specifically be a drawer defining a storage space that is kept at a desired humidity that may be different from the remainder of the fresh food compartment 12, but that is optimal for maintaining freshness of fruits and vegetables.

The refrigerator 10 includes an outer shell, frame, or housing that comprises several exterior panels or walls 24. The outer shell, frame, or housing that comprises several exterior panels or walls 24 may also be referred to as the refrigerator cabinet wrapper. The exterior walls 24 may include a rear or back wall, a top wall, a bottom wall, and two side walls. The two side walls may be referred to as first and second side walls. An insulating material, such as an insulating foam, may be disposed between each exterior wall 24 and an adjacent corresponding interior wall 16 in order reduce the heat transfer from the ambient surroundings to the fresh food compartment 12 and the freezer compartment 14, which increases the efficiency of the refrigerator 10.

The refrigerator 10 may have one or more doors 26, 28 that provide selective access to the interior volume of the refrigerator 10 where consumables may be stored. As shown, the fresh food compartment door is designated 26, and the freezer door is designated 28. The doors 26, 28 may be rotatably secured to the frame or housing of the refrigerator 10 by one or more hinges.

The doors 26, 28 may each include an exterior panel 30 and an interior panel 32 that is disposed on an internal side of the respective exterior panel 30 of each door 26, 28. The interior panels 32 may be configured to face the fresh food compartment 12 and freezer compartment 14 when the doors 26, 28 are in closed positions. The interior panels 32 may more specifically be door liners. An insulating material, such as an insulating foam, may be disposed between the exterior panels 30 and an adjacent corresponding interior panel 32 of each door 26, 28 in order reduce the heat transfer from the ambient surroundings and increase the efficiency of the refrigerator 10.

The doors 26, 28 may also include storage bins 34 that are able to hold food items or containers. The storage bins 34 may be secured to the interior panels 32 of each door 26, 28. Alternatively, the storage bins 34 may integrally formed within or defined by the interior panels 32 of each door 26. 28. In yet another alternative, a portion of the storage bins 34 may be secured to the interior panels 32 the doors 26, 28, while another portion of the storage bins 34 may be integrally formed within or defined by the interior panels 32 the doors 26, 28. The storage bins 34 may include shelves (e.g., a lower surface upon, which a food item or container may rest upon) that extend from back and/or side surfaces of the interior panels 32 of the doors 26, 28.

Figure 2:
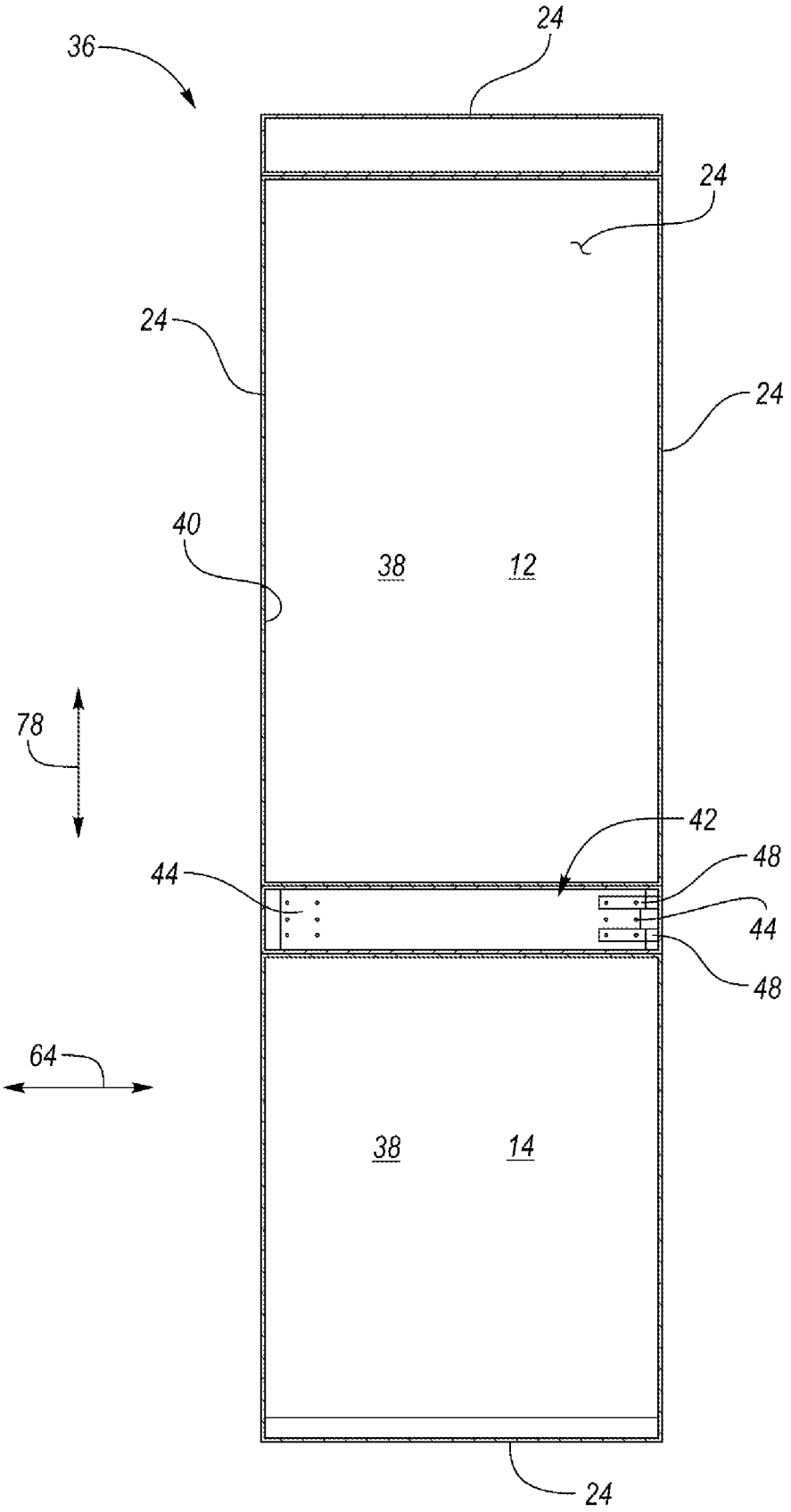
FIG. 2 is a front view of an outer housing or cabinet wrapper of the refrigerator.

Referring to FIG. 2, the outer shell, frame, or housing 36 that comprises the several exterior panels or walls 24 is further illustrated. Again, the outer shell, frame, or housing that comprises the several exterior panels or walls 24 may also be referred to as the refrigerator cabinet wrapper. The housing 36 defines an internal cavity 38. The walls 24 define an opening 40 the internal cavity 38. More specifically, the top wall, bottom wall, and two side walls of the several walls 24 define the opening 40 to the internal cavity 38 therebetween.

A reinforcement crossbar or crossmember 42 spans the opening 40 and is secured to each of the side walls 24. More specifically, the crossmember 42 includes first and second opposing ends 44 that are secured to the first and second side walls 24, respectively. The crossmember 42 divides the internal cavity 38 into first and second compartments. More specifically, the crossmember 42 divides the internal cavity 38 into the fresh food compartment 12 and freezer compartment 14. The crossmember 42 also divides the opening 40 into top and bottom openings.

The crossmember 42 may be connected to the housing 36 along the side walls 24 and along an interior of the refrigerator 10 to prevent deformation in a substantially horizontal direction of the side walls 24, particularly during an insulation fill process. Substantially horizontal may refer to any incremental angle that is between exactly horizontal and 15° from exactly horizontal. The insulation fill process is a process where an insulating material or foam is sprayed onto the interior of the housing 36. Such an insulating material or foam will be disposed between the housing and inner liner when the refrigerator is completely assembled.

Figure 3:
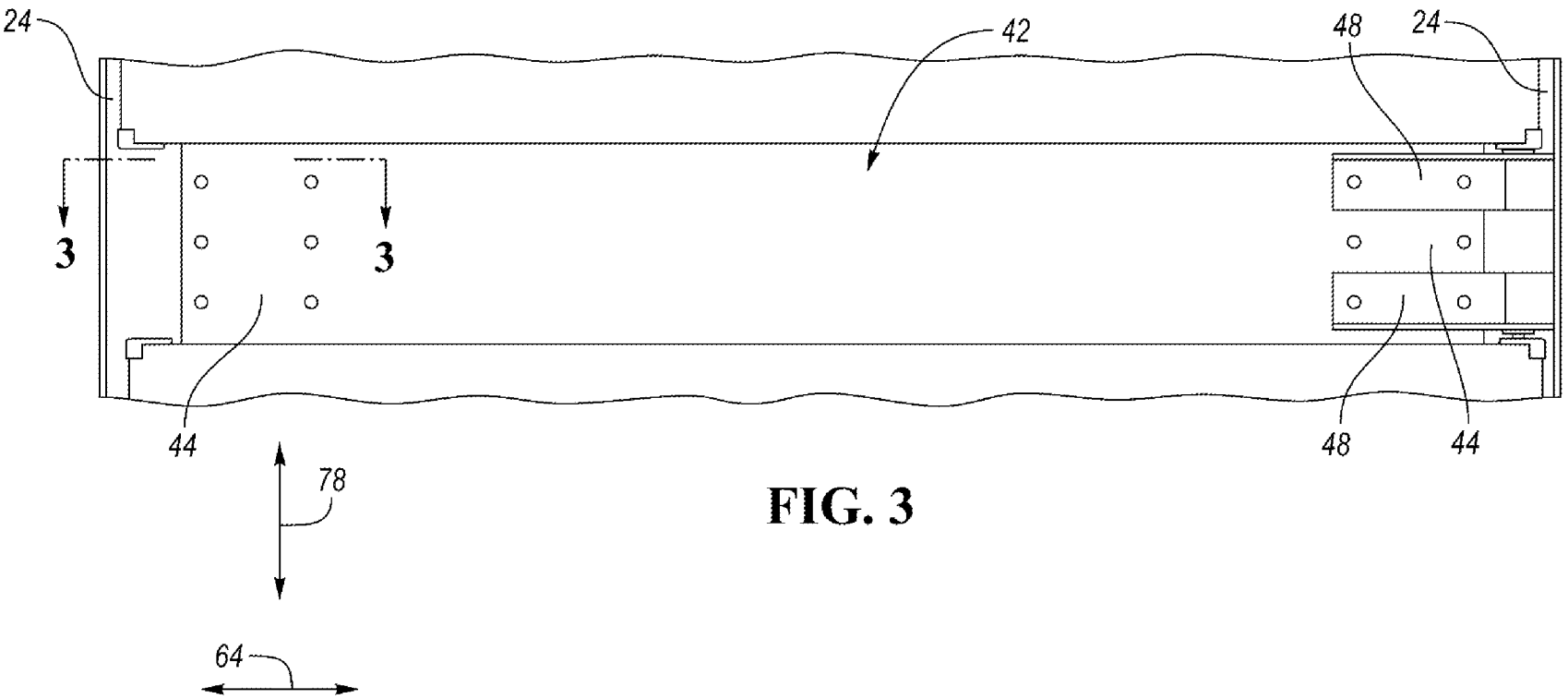
FIG. 3 is a magnified front view of a crossmember that secures opposing side panels or walls of the outer housing to each other.
Figure 4:
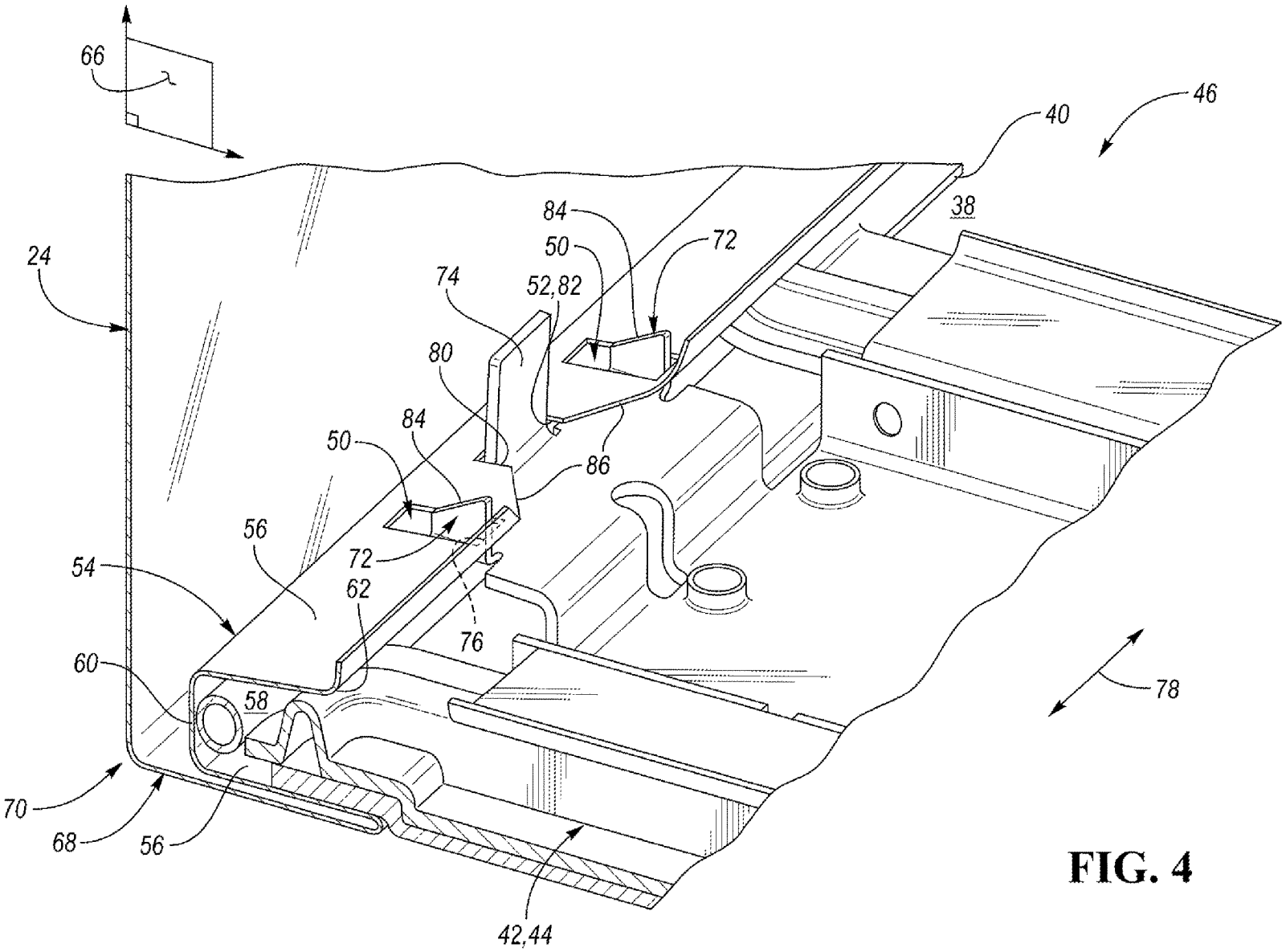
FIG. 4 is a partial cross-sectional view taken along line 4-4 in FIG. 3 illustrating a joint or connection between the crossmember and the side panels of the outer housing.

Referring to FIGS. 3 and 4, the crossmember 42 and a joint or connection 46 between the crossmember 42 and the side walls 24 are further illustrated. The crossmember 42 provides additional stability to the housing 36 of the refrigerator 10. Hinges 48 may be mounted to one of the first and second opposing ends 44 of the crossmember 42. The doors 26, 28 in turn may be rotatably secured to the hinges. It is noted that the connection 46 illustrated in FIG. 4 may represent the connections of the crossmember 42 at each of the first and second opposing ends 44 to the first and second side walls 24, respectively. It is further noted that the connection of the crossmember 42 at the first of the opposing ends 44 to the first of the side walls 24 may be the mirror image of the connection of the crossmember 42 at the second the opposing ends 44 to the second of the side walls 24.

The side walls 24 may each define at least one slot 50 and at least one notch 52. More specifically, each of the side walls 24 may define one notch 52 that is sandwiched between a pair of slots 50. Each of the side walls 24 may include a C-shaped or U-shaped protrusion 54 that extends from the side wall 24 and into the opening 40 and/or internal cavity 38. Each U-shaped protrusion 54 has first and second flanges 56 defining a space 58 therebetween. Each opposing end 44 of the crossmember 42 extends into the space 58 defined between the first and second flanges 56 of one of the U-shaped protrusions 54. The first and second flanges 56 may also be referred to as an opposing pair of flanges. The U-shaped protrusion 54 also includes a web 60. The first and second flanges 56 may be secured to and may extend from the web 60 and into the opening 40 and/or the internal cavity 38. More specifically, the first and second flanges 56 may form an open end 62 of each U-shaped protrusion 54 that extends into the opening 40 and/or the internal cavity 38.

The first and second flanges 56 of each U-shaped protrusion may be substantially perpendicular to a respective web 60 of each U-shaped protrusion. Each web 60 may also be substantially perpendicular to the respective side wall 24 that the U-shaped protrusion 54 extends from. Substantially perpendicular may refer to any incremental angle that is between exactly perpendicular and 15° from exactly perpendicular. Each web 60 may be substantially parallel to and spaced apart from the respective side wall 24 that the U-shaped protrusion 54 extends from. Substantially parallel may refer to any incremental angle that is between exactly parallel and 15° from exactly parallel.

Each U-shaped protrusion 54, including the corresponding first and second flanges 56 and corresponding open end 62, may extend into the opening 40 and/or the internal cavity 38 in a substantially horizontal direction. A horizontal direction may also be referred to as an X-direction. Substantially horizontal may refer to any incremental angle that is between exactly horizontal and 15° from exactly horizontal. A horizontal direction is illustrated by double arrow 64 in FIGS. 2 and 3. A horizontal plane 66 is illustrated in FIG. 4.

One of the first and second flanges 56 may define the at least one slot 50 and the at least one notch 52. The U-shaped protrusion 54 of each side wall 24, including the first and second flanges 56 and the web 60, may be a folded-over from a respective side wall 24 (e.g., the U-shaped protrusion 54 and respective side wall 24 may be made from a common workpiece, such as a panel of sheet metal). Each U-shaped protrusion 54 therefore, may be referred to as a folded outer wrapper edge 68 forming a three-sided box, where the three-sided box includes the first and second flanges 56 and the web 60. A folded outer wrapper edge 68 that forms a three-sided box may extend from a front region 70 of each of the first and second side walls 24 and into the opening 40 and/or the internal cavity 38. The front region 70 of the first and second side walls 24 may correspond to front edges of the first and second side walls 24 that are opposite to a region where the side walls 24 are connected to a back wall of the housing 36. At least one surface of the three-sided box defines the at least one slot 50 and the at least one notch 52.

Each opposing end 44 of the crossmember 42 may include at least one first tab or protrusion 72 and may include at least one second tab or protrusion 74 that are utilized to secure the crossmember 44 to the first and second side walls 24. More specifically, each opposing end 44 of the crossmember 42 may include two first protrusions 72 and one second protrusion 74 that is sandwiched between the two first protrusions 72. Each first protrusion 72 extends into one of the slots 50 and each second protrusion 74 extends into one of the notches 52. More specifically, each first protrusion 72 extends in a substantially horizontal direction from the end 44 of the crossmember 42 and into one of the slots 50 and each second protrusion 74 extends in a substantially horizontal direction from the end 44 of the crossmember 42 and into one of the notches 52. Substantially horizontal may refer to any incremental angle that is between exactly horizontal and 15° from exactly horizontal.

Each first protrusion 72 engages one of the first and second side walls 24, or more specifically one of flanges 56, along proximal ends 76 of one of the slots 50 in order to limit or restrict movement of the crossmember 42 in a substantially horizontal direction relative to the side walls 24. Substantially horizontal may refer to any incremental angle that is between exactly horizontal and 15° from exactly horizontal. A horizontal direction is illustrated by double arrow 64 in FIGS. 2 and 3. More specifically, engagement of the first protrusions 72 within the notches 50 may slightly displace the first and second side walls 24 in directions toward each other such that the first and second side walls 24 generate a tension force on the crossmember 42, which forces engagement between each first protrusion 72 and the side walls 24 along corresponding proximal ends 76 of one of the slots 50 and secures or locks the crossmember 42 to each of the first and second side walls 24.

Each second protrusion 74 engages one of the first and second side walls 24, or more specifically one of flanges 56, within one of the notches 52 to limit or restrict movement of the crossmember 42 relative to the side walls 24 in a substantially vertical direction. Substantially vertical may refer to any incremental angle that is between exactly vertical and 15° from exactly vertical. A vertical direction is illustrated by double arrow 78 in FIGS. 2-4. A vertical direction may also be referred to as a Y-direction. More specifically, each second protrusion 74 may engage the first and second side walls 24, or more specifically one of flanges 56, along a top or upper end 80 and a bottom or lower end 82 of one of the notches 52 to limit or restrict movement of the crossmember 42 in a substantially vertical direction.

Each first protrusion 72 and each second protrusion 74 may be substantially perpendicular to the flanges 56. Substantially perpendicular may refer to any incremental angle that is between exactly perpendicular and 15° from exactly perpendicular. Each first protrusion 72 may have an inclined shape or a ramped surface 84 that is configured to guide or facilitate insertion of each first protrusion 72 into a respective slot 50. Stated in other terms the ramped surface 84 facilitates assembly of the crossmember 42 to the side walls 24 via allowing each first protrusion 72 to slide into and engage a respective slot 50. One of the flanges 56 of each U-shaped protrusion 54 has at least one ramped surface 86 configured to guide a respective second protrusion 74 toward a respective notch 52. More specifically, the flange 56 may include two ramped surfaces 86.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a housing defining an internal cavity and having first and second side walls, wherein the first and second side walls define an opening to the internal cavity therebetween and each of the first and second side walls define at least one slot and at least one notch; and a crossmember (i) spanning the opening, (ii) dividing the internal cavity into first and second compartments, and (iii) having first and second opposing ends secured the first and second side walls, respectively, the first and second opposing ends each including (i) at least one first protrusion extending into the at least one slot of the first and second side walls, respectively, (ii) at least one second protrusion extending into the at least one notch of the first and second side walls, respectively, wherein the at least one first protrusion of the first and second opposing ends engages the first and second side walls along proximal ends of the at least one slot of the first and second side walls, respectively, and wherein the at least one second protrusion of the first and second opposing ends engages the first and second side walls within the at least one notch of the first and second side walls, respectively.

2. The refrigerator of claim 1 further comprising U-shaped protrusions extending into the opening from the first and second side walls, wherein the U-shaped protrusions have open ends facing toward the opening, and wherein the first and second opposing ends of the crossmember are disposed within the open ends of the U-shaped protrusions of the first and second side walls, respectively.

3. The refrigerator of claim 2, wherein each of the U-shaped protrusions have a web and an opposing pair of flanges extending into the opening from the web.

4. The refrigerator of claim 3, wherein one of the flanges of each U-shaped protrusion defines the at least one notch and the at least one slot of each of the first and second side walls.

5. The refrigerator of claim 4, wherein each web is substantially parallel to the first and second side walls.

6. The refrigerator of claim 5, wherein each flange is substantially perpendicular to a respective web.

7. The refrigerator of claim 4, wherein one of the flanges of each U-shaped protrusion has at least one ramped surface configured to guide the at least one second protrusion of each of the first and second opposing ends toward the at least one notch of the first and second side walls, respectively.

8. The refrigerator of claim 1, wherein each at least one first protrusion has a ramped surface configured to facilitate insertion of the at least one first protrusion into a respective at least one slot.

9. A refrigerator comprising:

a side panel partially defining an internal cavity;

a U-shaped protrusion extending from the side panel, the protrusion having first and second flanges defining a space therebetween and extending horizontally into the cavity, wherein the first flange defines a slot and a notch;

a crossmember having an end extending into the space between the first and second flanges;

a first protrusion extending from the end of the crossmember and horizontally into the slot, and engaging the first flange within the slot to restrict horizontal movement of the crossmember relative to the side panel; and a second protrusion extending from the end of the crossmember and horizontally into the notch, and engaging the first flange within the notch to restrict vertical movement of the crossmember relative to the side panel.

10. The refrigerator of claim 9, wherein the first and second flanges are substantially perpendicular to the side panel.

11. The refrigerator of claim 9, wherein the first protrusion is substantially perpendicular to the first flange.

12. The refrigerator of claim 9, wherein the second protrusion is substantially perpendicular to the first flange.

13. The refrigerator of claim 9, wherein the U-shaped protrusion further comprises a web, and wherein the first and second flanges extend from the web.

14. The refrigerator of claim 13, wherein web is substantially parallel to and spaced apart from the side panel.

15. The refrigerator of claim 9, wherein the first protrusion has a ramped surface configured to facilitate insertion of the first protrusion into the slot.

16. The refrigerator of claim 9, wherein the first flange has a least one ramped surface configured to guide the second protrusion into the notch.

17. A refrigerator comprising:

a refrigerator cabinet wrapper, the wrapper having a first side panel and a second side panel;

a folded outer wrapper edge forming a three-sided box extending from a front region of the first side panel and the second side panel;

at least one slot defined in at least one surface of the three-sided box;

a notch defined in the at least one surface of the three-sided box;

a refrigerator reinforcement crossbar; and at least one tab and at least one protrusion each extending from a first end and a second end of the reinforcement crossbar, wherein the at least one protrusion is configured to engage the at least one slot and the at least one tab is configured to abut the notch such that the crossbar is locked to the folded outer wrapper edge in an X-direction.

18. The refrigerator of claim 17, wherein the notch and slot are defined on a same side of the three-sided box.

19. The refrigerator of claim 17, wherein the at least one protrusion has an inclined shape to facilitate assembly via allowing the at least one protrusion to slide into and engage the at least one slot.

20. The refrigerator of claim 17, wherein the cabinet wrapper and the reinforcement crossbar are joined from an interior of the refrigerator cabinet wrapper to prevent a deformation in the X-direction of the first and second side panels during an insulation fill process.

* * * * *